US006357951B1

(12) United States Patent
Tibbetts

(10) Patent No.: US 6,357,951 B1
(45) Date of Patent: Mar. 19, 2002

(54) LOOSE-LEAF BINDER ASSEMBLY

(76) Inventor: Paul R. Tibbetts, 184 Breckenridge St., Palmer, MA (US) 01069

( * ) Notice: Subject to any disclaimer, the term of this patent is extended or adjusted under 35 U.S.C. 154(b) by 0 days.

(21) Appl. No.: 09/504,455

(22) Filed: Feb. 16, 2000

Related U.S. Application Data

(60) Provisional application No. 60/124,326, filed on Mar. 13, 1999.

(51) Int. Cl.[7] ..... B42F 3/00

(52) U.S. Cl. ..... 402/70; 24/67 R; 402/71; 402/75; 411/81

(58) Field of Search ..... 402/36, 70, 71, 402/73, 75, 63; 411/81, 166; 24/67 R, 67.1

(56) References Cited

U.S. PATENT DOCUMENTS 1,051,089 A 1/1913 David
1,709,955 A * 4/1929 Schade
1,909,944 A * 5/1933 Franz, Jr.
2,238,106 A * 4/1941 Fleisher
2,335,593 A * 11/1943 Howe
2,513,037 A * 6/1950 McLaughlin ..... 411/166
2,570,966 A 10/1951 Moore
4,180,340 A * 12/1979 Cosby ..... 402/63
5,294,226 A * 3/1994 Chow ..... 411/338
5,718,530 A * 2/1998 Tibbetts ..... 402/73

* cited by examiner

*Primary Examiner*—A. L. Wellington
*Assistant Examiner*—Monica Carter
(74) *Attorney, Agent, or Firm*—Robert A. Seemann

(57) ABSTRACT

A cavity formed in a plate of a spine of a loose-leaf binder is open at the front of the cavity toward the back of the spine and is configured to hold a nut and prevent rotation of the nut in the cavity and to receive a threaded screw clearingly of the screw threads through the back of the cavity for threading the screw in the threads of the nut.

5 Claims, 4 Drawing Sheets

LOOSE-LEAF BINDER ASSEMBLY

This application claims the benefit of U.S. Provisional Application No. 60/124,326, filed Mar. 13, 1999.

BACKGROUND OF THE INVENTION

1. Field of the Invention

The invention pertains to loose-leaf binders, more specifically to a spine designed to hold a threaded nut for attaching the binder ring mechanism to the spine.

2. Description of the Prior Art

U.S. Pat. No. 1,051,089 patented Jan. 21, 1913 by R. C. David describes an upwardly open C-shaped slot extending the length of the spine of a binder. A nut slides in the slot. A tubular post designed to receive a hole in paper destined for the binder has a flange on the bottom of the post that is larger in diameter than the slot opening so that when the post is drawn to the nut by a screw through the tubular opening, the shoulders of the slot are clamped between the upper surface of the nut and the flange. The post may be mounted anywhere along the length of the slot by sliding the nut to the desired location and tightening the screw.

U.S. Pat. No. 2,570,966 patented Oct. 9, 1951 by H. H. More describes an upwardly open C-shaped slot extending along a length of the spine of the binder. A threaded block slides in the slot. A post designed to receive a hole in paper destined for the binder has a threaded extension extending axially from the bottom of the post, the bottom of the post being wider than the opening of the slot for clamping the shoulders of the slot between the bottom of the post and the block.

In one arrangement the shoulders of the slot have a downward depending flange skirt that is received in slots in the block which resist lateral movement of the block.

In another arrangement means are provided for supporting a paper post in the threaded block adjacent to the threads, and the threaded block is fastened in the channel by pressing it against the shoulders by counter force of a thumb screw in the slot extending through the block and bearing on the bottom of the C. The threaded block is a first block and the C is formed in a second block. The base of the binder is hollow, having aligned slots in the top and bottom of the base, and the second block carrying the first block and post, tracks along between the top and bottom slots by means of the shaft of the thumb screw in the top slot, and by a set screw shaft in the bottom slot that is used to fasten the second block to the base at anywhere along the length of the bottom slot.

SUMMARY OF THE INVENTION

It is one object of the invention to provide a loose-leaf binder assembly in which the binder mechanism is mounted on the front of the spine with a screw.

It is another object that a nut adapted to receive the screw is held within the spine.

It is another object that the nut is received in a cavity formed in the spine, the front of the cavity being open toward the back of the spine.

It is another object that the screw extends into the nut through an opening in the back of the cavity at the front of the spine.

A binder assembly includes a base, a binder mechanism, a hole through the binder mechanism for a screw, a plate having an integrally formed raised portion of the top of said plate forming a downwardly open cavity configured to receive a threaded nut of known thread diameter and known shape through the bottom of the plate, the wall of the cavity being shaped to closely fit a portion of the nut so that the wall of the cavity prevents rotation of the nut in the cavity, the downward opening being a first opening, a second opening in the top of the cavity, the diameter of the second opening being larger than the diameter of the threaded opening in the nut and smaller than the diameter of the nut, the raised portion being positioned on the plate for receiving a screw through the second opening when the binder mechanism is mounted on the plate and the screw extends through the hole in the binder mechanism.

BRIEF DESCRIPTION OF THE DRAWINGS

In order that the invention be more fully comprehended, it will now be described, by way of example, with reference to accompanying drawings, in which.

DESCRIPTION OF THE PREFERRED EMBODIMENTS

Figure 1:
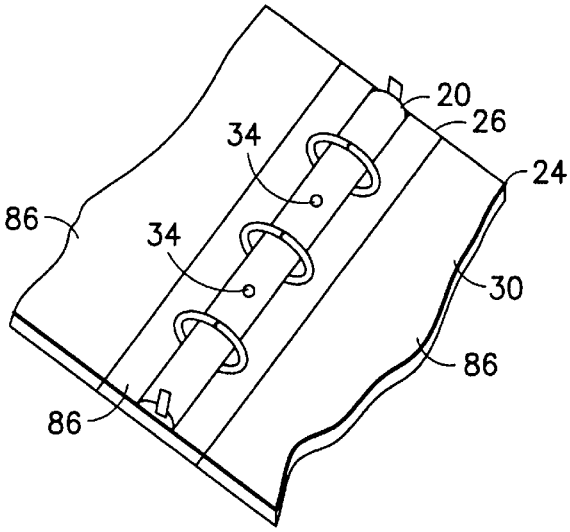
FIG. 1 is a partial perspective top schematic view of the invention in a three-ring loose leaf binder assembly.
Figure 3:
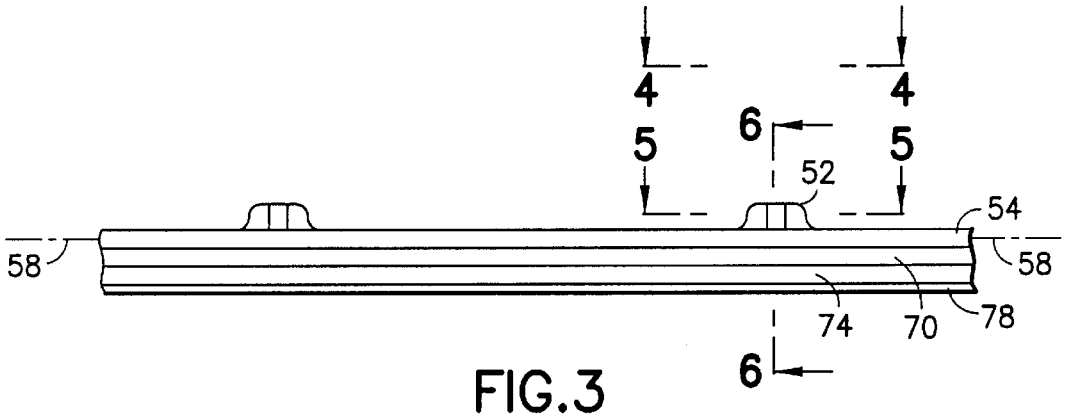
FIG. 3 is a front view of a portion of the loose-leaf binder assembly of FIG. 1.
Figure 4:
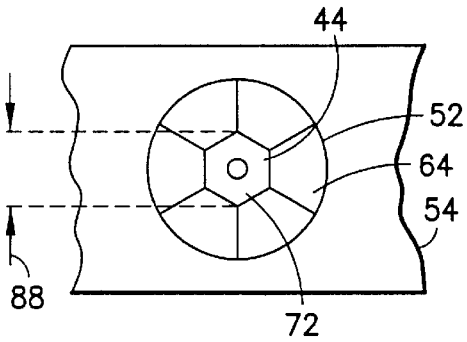
FIG. 4 is a top view of the loose-leaf binder assembly of FIG. 3 taken along 4—4.
Figure 5:
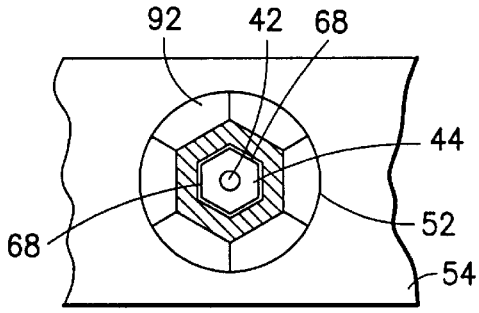
FIG. 5 is a top view of the loose leaf binder assembly of FIG. 3 taken along 5—5.
Figure 2:
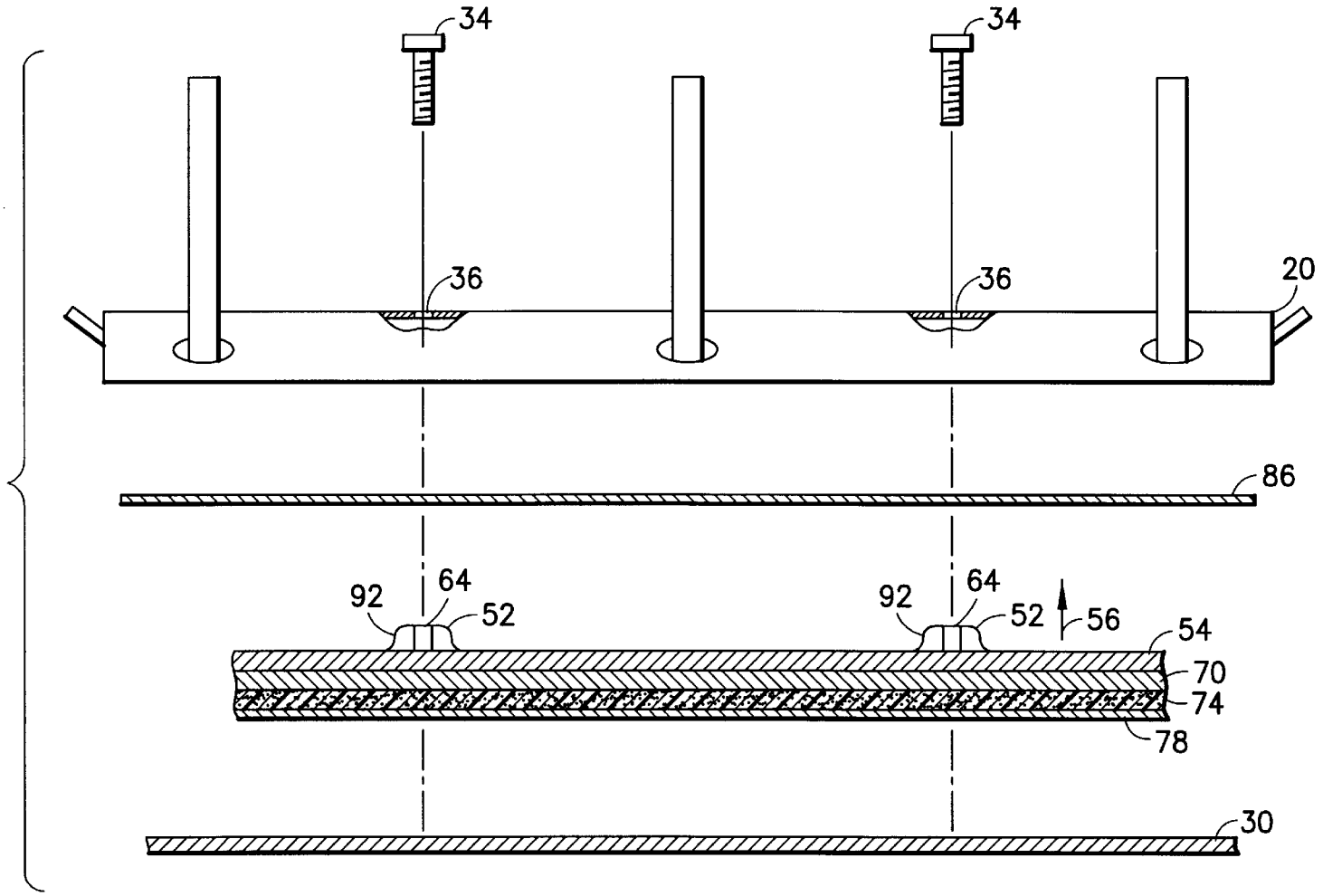
FIG. 2 is a front exploded view of the loose-leaf binder assembly of FIG. 1.
Figure 6:
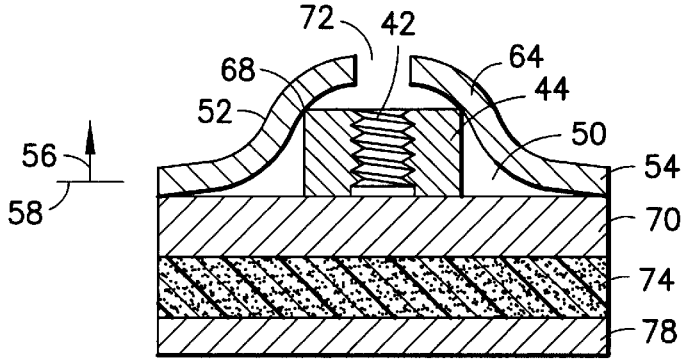
FIG. 6 is a side view of the loose-leaf binder assembly of FIG. 3 taken along 6—6.
Figure 7:
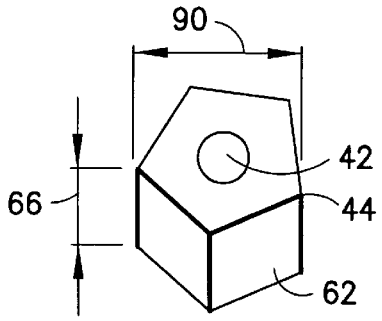
FIG. 7 is a perspective view of the nut of FIG. 6.
Figure 8:
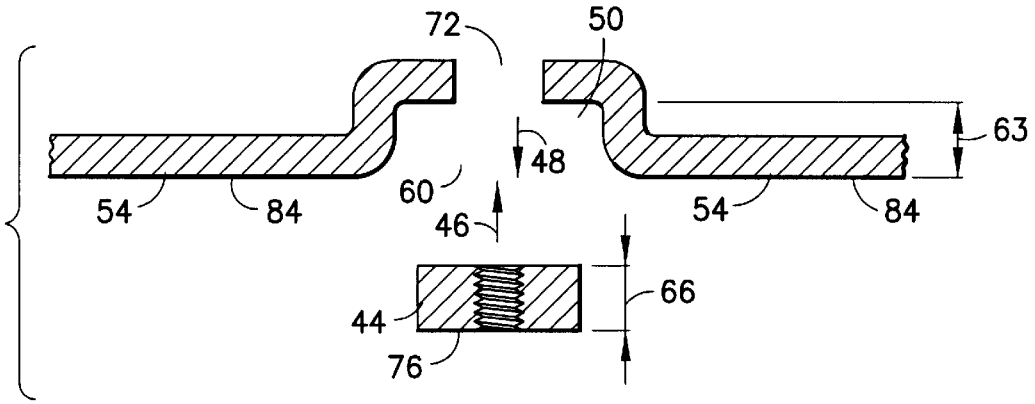
FIG. 8 is a cross section view of installation of the nut in the plate of FIG. 6.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 1–8, ring binder mechanism 20 of loose-leaf binder assembly 24 is attached to spine 26 of cover 30 by machine screws 34, each of which is inserted through a fixed or known location hole 36.

Machine screw 34 is threaded into threaded opening 42 in nut 44. Nut 44 is received by cavity 50 which is formed by displacing portion 52 of metal plate 54 upward 56 from the plane 58 of plate 54. The nut is inserted upward 46 generally normal to plate 54 into cavity 50, directly through downward 48 opening 60.

Upwardly depending wall 64 of portion 52 is formed to closely fit 68 a flat side 62 or an edge on nut 44 so that wall 64 prevents rotation of the nut in cavity 50.

Preferably depth 63 of opening 50 is at least as great as the height 66 of nut 44 so that the nut can be inserted until bottom 76 of the nut is on level with or above bottom 84 of plate 54.

Diameter 88 of opening 72 is larger than the diameter of threaded opening 42. Preferably opening 72 is large enough to permit screw 34 to extend into opening 42 without impedance from the wall of portion 52. The threads of screw 34 do not threadingly engage wall portion 52. Diameter 88 of opening 72 is smaller than diameter 90 of nut 44.

Although the outer surface 92 of portion 52 in the drawings displays facets indicative of a faceted surface wall within the cavity that engages the nut to prevent rotation of the nut, it is not necessary to the invention that outer surface 92 has facets. It is possible to form the wall of the cavity with an inwardly facing antirotation nut engaging surface and have the outer surface of portion 52 being smooth and round.

Stiff press board or cardboard plate 70 prevents the nut from comming out of cavity 50 after the nut is inserted into cavity 50 by way of opening 60.

Elastic foam board 74 is attached to plate 70 and to stiff cardboard plate 78 to which cover 30 is affixed by glue or staples. Decorative paper 86 covers plate 54 and extends over cover 30.

Each of the two discrete raised portions 52 is made at a location on plate 54 that will be in alignment with a screw 34.

Figure 9:
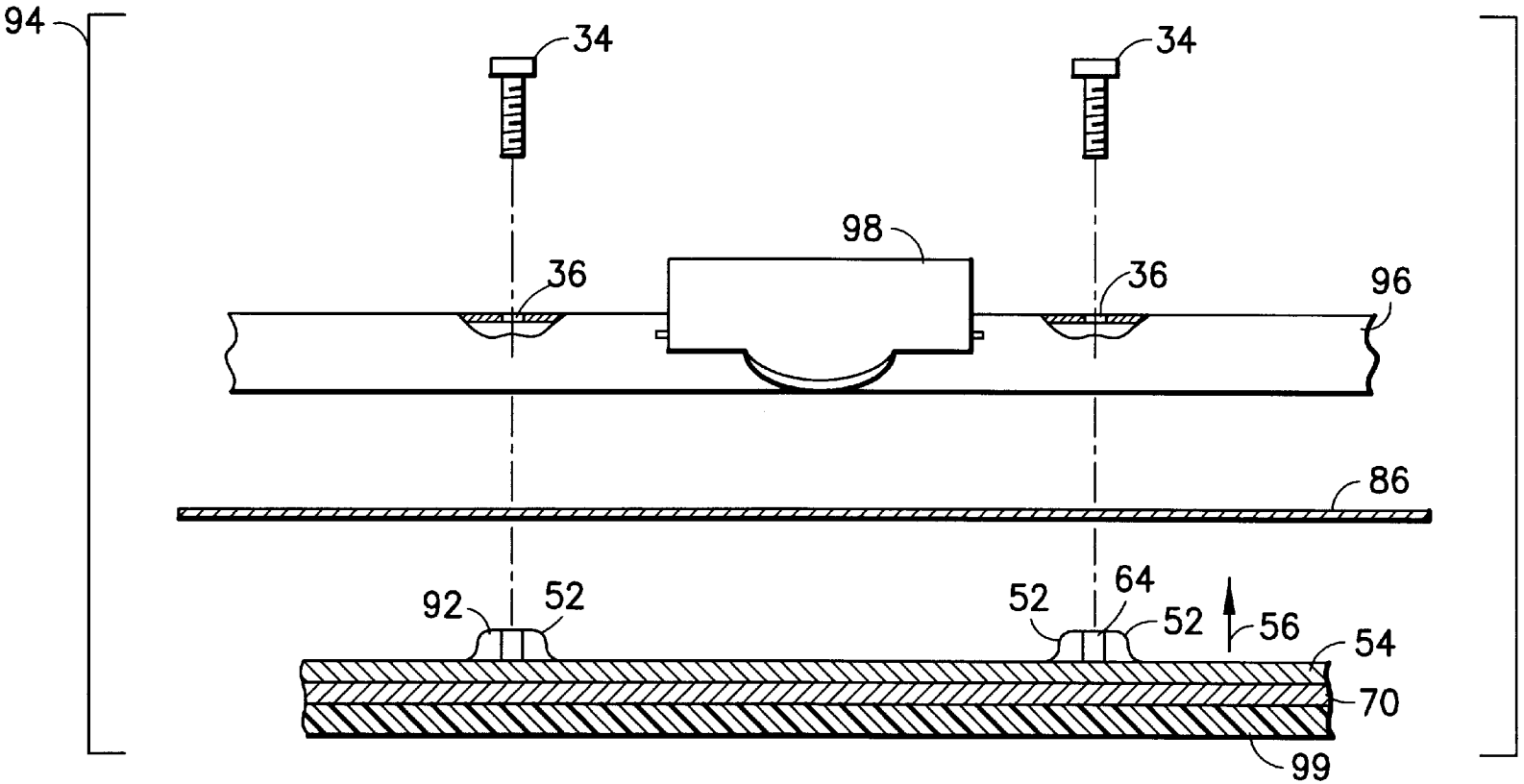
FIG. 9 is a partial perspective top schematic view of the invention in a spring clip loose leaf binder assembly.

In FIG. 9, binder clip mechanism 96 of clipboard 94 comprising spring paper clip 98 is attached to rigid plastic board 99 by machine screws 34 like ring binder mechanism 20 is attached by the invention to spine 26 of cover 30, described earlier.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

Drawing Designators (Informal List)

20 ring binder mechanism
24 loose-leaf binder assembly
26 spine of cover 30
30 cover
34 machine screw
36 hole
42 threaded opening in nut 44
44 nut
46 upward
48 downward
50 cavity
52 portion
54 metal plate
56 upward, direction arrow
58 plane of plate
60 opening of cavity for receiving nut
62 flat side
63 depth of opening 50
64 wall
66 height
68 closely fit
70 cardboard plate
72 opening
74 elastic foam board
76 bottom of nut
78 cardboard plate
84 bottom of plate 54
86 decorative paper
88 diameter
90 diameter of nut
92 outer surface of portion 52
94 clip board
96 clip binder mechanism
98 paper clip
99 rigid plastic board

What is claimed is:

1. An apparatus for mounting a binder mechanism on a binder base having a front and a back, the apparatus comprising:

a first plate having a front and a back, a raised portion of said first plate forming a cavity having a front and a forward extending wall to the back of said cavity, a nut mounted in said cavity, said nut having a top, a bottom, and a vertical outer wall extending from the top toward the bottom, said vertical outer wall having a surface configured for gripping of the nut to control rotation of the nut, and an opening in said top of said nut adapted for engaging threads of a screw, said forward extending wall being in contact with said vertical outer wall surface configured for gripping of said nut so that said cavity prevents rotation of said nut in said cavity, said cavity being open at the front of said cavity toward the back of said plate sufficiently in size for receiving said nut through the back of said plate, said plate extending across the top of said nut at the back of said cavity, an opening in said plate at the back of said cavity for receiving a threaded screw of known diameter clearingly of the screw threads for threading the screw in the threads of said nut.

2. The apparatus of claim 1 further comprising:

a second plate extending over the front of said cavity, enclosing said nut in said cavity, said cavity being configured to contact said nut laterally against lateral movement of said nut in said cavity.

3. In a binder assembly comprising a base, a binder mechanism, a hole through the binder mechanism for a screw, the improvement comprising:

a plate having a top and a bottom, mounted on said base, an integrally formed raised portion of said plate forming a cavity downwardly open at the front of the cavity and an upward extending wall to the back of said cavity, said cavity being configured to receive a threaded nut of known thread diameter and known shape through the bottom of said plate, a nut having a top, mounted in said cavity, said upward extending wall of said cavity being shaped to closely fit a portion of the nut so that said upward extending wall of said cavity prevents rotation of the nut in said cavity, said plate extending across the top of said nut at the back of said cavity, the downward opening being a first opening, a second opening in the top of said cavity, the diameter of the second opening being larger than the diameter of the threaded opening in said nut and smaller than the diameter of said nut, said raised portion being positioned on said plate for receiving a screw through the second opening when the binder mechanism is mounted on said plate, and the screw extends through the hole in the binder mechanism, through said second opening and into said nut, for mounting said binder mechanism on said base.

4. A loose-leaf binder assembly comprising:

a binder mechanism, a spine having a front and a back, comprising a plate having a top and a bottom, an integrally formed raised portion of said plate forming a cavity having a front and a back and an upward extending wall to the back of said cavity, the front of the cavity being open toward the back of the spine, p1 a nut in said cavity, said upward extending wall of said cavity being shaped to closely fit a portion of the nut so that said upward extending wall prevents rotation of the nut in said cavity, said plate extending across the top of said nut at the back of said cavity, a screw having threads, extending through said binder mechanism, through the back of said cavity, and into said nut, the threads of the screw engaging said nut.

5. In a binder assembly comprising a base, a binder mechanism, a first hole through the binder mechanism for a first screw, a second hole through the binder mechanism for a second screw, spaced from said first hole, the improvement comprising:

a plate having a top and a bottom, mounted on said base, a first integrally formed raised portion of said plate forming a first cavity downwardly open at the front of said first cavity and an upward extending wall to the back of said first cavity, said cavity being configured to receive a threaded nut of known thread diameter and known shape through the bottom of said plate, a first nut having a top, mounted in said first cavity said upward extending wall of said first cavity being shaped to closely fit a portion of the first nut so that said upward extending wall of said first cavity prevents rotation of the first nut in said first cavity, said plate extending across the top of said nut at the back of said first cavity, the downward opening being a first opening, a second opening through the plate at the top of said first cavity, the diameter of the second opening being larger than the diameter of the threaded opening in said first nut and smaller than the diameter of said first nut, said raised portion being positioned on said plate for receiving a screw through the second opening when the binder mechanism is mounted on said plate, a first screw extending through the first hole in the binder mechanism through said second opening not threadingly engaged by the first screw threads, into said first nut, for mounting said binder mechanism on said base, a second integrally formed raised portion of said plate forming a second downwardly open cavity, a second nut in said cavity, said second screw extending through said binder mechanism, through the top of said plate not threadingly engaged by the screw threads, and into said second nut, the threads of said second screw engaging said second nut.

* * * * *